US011318747B2

(12) United States Patent
Tanaka et al.

(10) Patent No.: US 11,318,747 B2
(45) Date of Patent: May 3, 2022

(54) RECORDING APPARATUS

(71) Applicant: SEIKO EPSON CORPORATION, Tokyo (JP)

(72) Inventors: Takuto Tanaka, Shiojiri (JP); Takeshi Aoki, Matsumoto (JP); Masaki Shimomura, Matsumoto (JP); Yusaku Amano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/162,327

(22) Filed: Jan. 29, 2021

(65) Prior Publication Data

US 2021/0237448 A1 Aug. 5, 2021

(30) Foreign Application Priority Data

Jan. 31, 2020 (JP) ..... JP2020-014812
Nov. 30, 2020 (JP) ..... JP2020-198131

(51) Int. Cl.
*B41J 2/165* (2006.01)
*B41J 11/00* (2006.01)
*B41J 13/02* (2006.01)

(52) U.S. Cl.
CPC ..... *B41J 2/16505* (2013.01); *B41J 2/16511* (2013.01); *B41J 2/16535* (2013.01); *B41J 11/007* (2013.01); *B41J 13/02* (2013.01); *B41P 2235/20* (2013.01)

(58) Field of Classification Search
CPC .. B41J 2/16505; B41J 2/16535; B41J 11/007; B41J 13/02; B41J 2/16511; B41P 2235/20
See application file for complete search history.

(56) References Cited

U.S. PATENT DOCUMENTS

2009/0073213 A1 3/2009 Iwata
2015/0274477 A1 10/2015 Kodama
2018/0236797 A1 8/2018 Ohashi et al.

FOREIGN PATENT DOCUMENTS

CN 103009829 A * 4/2013 ..... B41J 2/16588
JP 2004042537 A * 2/2004 ..... B41J 2/16547
JP 2009-072925 4/2009
JP 2010-214780 9/2010
JP 2013107272 A * 6/2013 ..... B41J 25/001
JP 2018-130960 8/2018
JP 2019-081659 5/2019
JP 2020-026071 2/2020

* cited by examiner

*Primary Examiner* — Sharon Polk
(74) *Attorney, Agent, or Firm* — Workman Nydegger

(57) ABSTRACT

The printer includes a transport unit having a support surface for supporting a medium, a line head recording on the medium by ejecting ink from a nozzle provided on an ejecting surface thereof, a head moving portion for moving the line head along a moving direction with respect to the transport unit, and a first maintenance unit movably provided in a first direction for covering the ejecting surface. The moving direction intersects a horizontal plane at an angle of 45 degrees or less, the first direction intersects the horizontal plane at an angle of 45 degrees or more and less than 90 degrees, and a movement amount of the first maintenance unit in the first direction is equal to or larger than a movement amount of the line head in the moving direction when the printer is installed on a horizontal plane.

20 Claims, 14 Drawing Sheets

RECORDING APPARATUS

The present application is based on, and claims priority from JP Application Serial Number 2020-014812, filed Jan. 31, 2020 and JP Application Serial Number 2020-198131, filed Nov. 30, 2020, the disclosures of which are hereby incorporated by reference herein in their entirety.

BACKGROUND

Technical Field

The present disclosure relates to a recording apparatus such as a printer.

Related Art

A recording apparatus including a head portion having an ejecting surface provided with nozzles for ejecting liquid to a medium is known from the related art, and an example thereof is described in JP-A-2019-081659.

However, in the recording apparatus described in JP-A-2019-081659, the space occupied by the head portion and the maintenance portion for maintaining the head portion may increase, and the installation area of the recording apparatus may increase.

SUMMARY

According to an aspect of the present disclosure, there is provided a recording apparatus that includes a support portion having a support surface configured to support a medium, a head portion having an ejecting surface that is disposed to face the support surface, and configured to record on the medium supported by the support surface by ejecting liquid from a nozzle provided on the ejecting surface, a head moving portion, along a moving direction in which the head portion advances and retreats with respect to the support portion, configured to move the head portion to a recording position at which recording on the medium is performed and a retreat position away from the support portion with respect to the recording position, and a cap portion configured to move in a first direction that intersects the moving direction, and configured to cover the ejecting surface at a position between the head portion and the support portion, in which when installed on a horizontal plane, the moving direction intersects the horizontal plane at an angle of 45 degrees or less, and the first direction intersects the horizontal plane at an angle of 45 degrees or more and less than 90 degrees, and a movement amount of the cap portion in the first direction is equal to or larger than a movement amount of the head portion in the moving direction.

DESCRIPTION OF EXEMPLARY EMBODIMENTS

1. Embodiment 1

Hereinafter, a printer 1 according to Embodiment 1 as an example of a recording apparatus according to the present disclosure will be described in detail.

Figure 1:
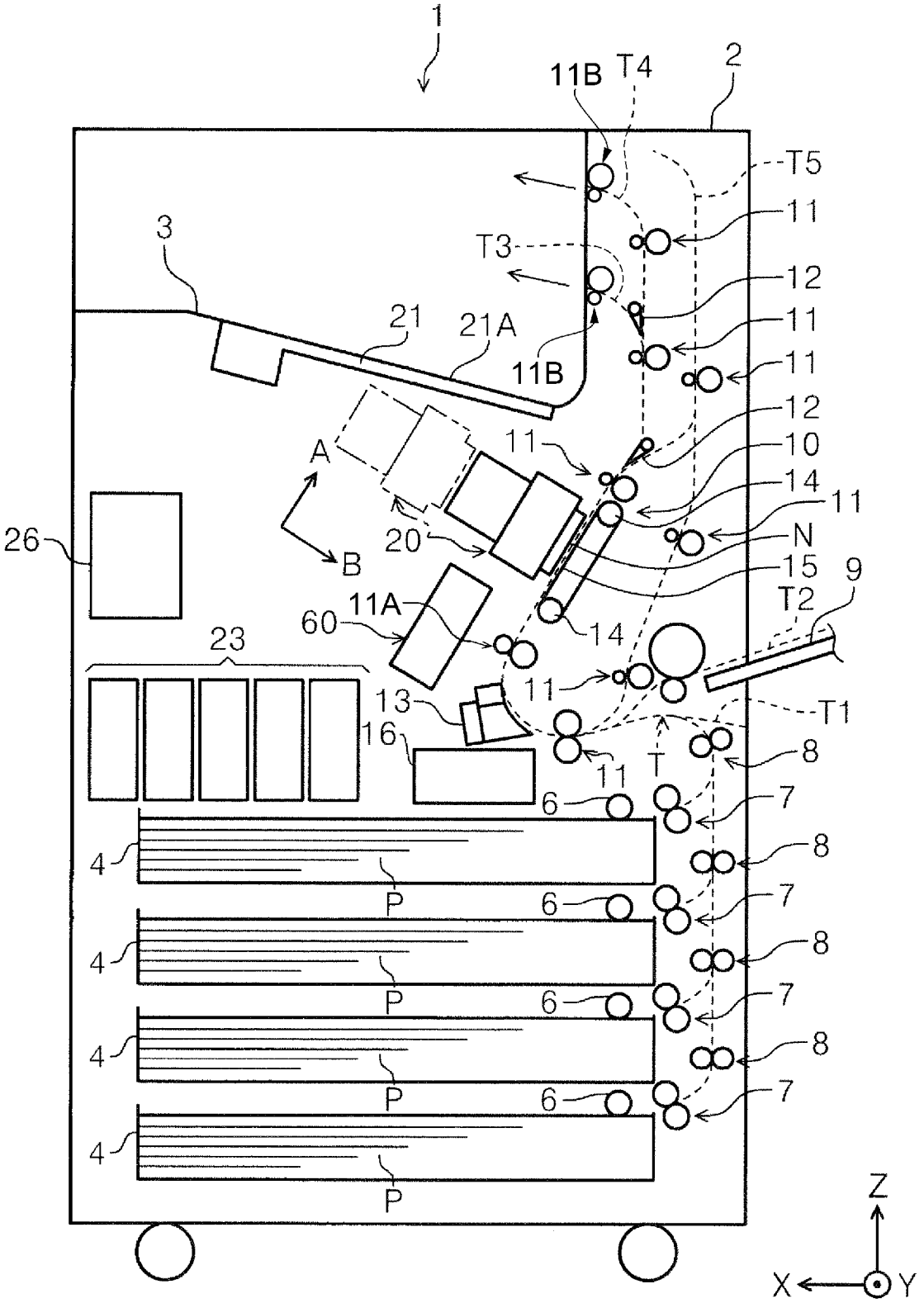
FIG. 1 is a diagram illustrating a transport route of a medium of a printer according to Embodiment 1.

FIG. 1 illustrates the printer 1 as the example of the recording apparatus. The printer 1 is configured as an ink jet apparatus that records by ejecting ink, which is an example of liquid, onto a medium P that is represented by a recording sheet.

The printer 1 is assumed to be placed on a horizontal plane, and an X-Y-Z coordinate system illustrated in each drawing is an orthogonal coordinate system in which three spatial axes, which are orthogonal to each other, are an X-axis, a Y-axis, and a Z-axis, respectively. In addition, the directions along the X-axis, Y-axis, and Z-axis are an X direction, Y direction, and Z direction, respectively, positive directions along the X-axis, Y-axis, and Z-axis toward the positive side are a +X direction, +Y direction, and +Z direction, respectively, negative directions along the X-axis, Y-axis, and Z-axis toward the negative side are a −X direction, −Y direction, and −Z direction, respectively, and the Z direction is a vertical direction, an upward direction along the vertical direction is the +Z direction, and a downward direction along the vertical direction is the −Z direction. An X-Y plane including the X-axis and the Y-axis is a horizontal plane. Further, an A-B coordinate system in which two spatial axes that are included in an X-Z plane including the X-axis and the Z-axis, intersect the X-axis and the Z-axis, and are orthogonal to each other as an A-axis and a B-axis, respectively, is an orthogonal coordinate system. In addition, a direction along the A-axis is an A direction, an upward direction along the A-axis is a +A direction, and a direction opposite to the +A direction is a −A direction, and a direction along the B-axis is a B direction, a downward direction along the B-axis is a +B direction, and a direction opposite to the +B direction is a −B direction.

The Y direction is a medium P width direction that intersects a transport direction of the medium P, an apparatus depth direction, and a horizontal direction. In addition, the Y direction is an example of the apparatus depth direction intersecting both the A direction and the B direction, which will be described later. The +Y direction is a direction toward a front in the Y direction, and the −Y direction is a direction toward a back in the Y direction.

The X direction is an apparatus width direction, which is the horizontal direction. When viewed from the person who operates the printer 1, the +X direction is a direction toward the left in the X direction and the −X direction is a direction toward the right in the X direction.

The Z direction is an apparatus height direction.

In the printer 1, the medium P is transported through a transport route T indicated by broken lines.

The A-B coordinate system illustrated in the X-Z plane is the orthogonal coordinate system. The A direction is an example of the transport direction of the medium P in an area facing a line head 20, which will be described later, of the transport route T. A direction toward the upstream in the A direction is referred to as the −A direction, and a direction toward the downstream is referred to as the +A direction. In the present embodiment, the A direction is a direction inclined so that the +A direction side is located on the +Z direction side with respect to the −A direction side. The B direction is an example of a moving direction, and is the moving direction in which the line head 20, which will be described later, advances or retreats with respect to a transport unit 10, which will be described later. In the B direction, a direction in which the line head 20 approaches the transport route T is referred to as the +B direction, and a direction in which the line head 20 is away from the transport route T is referred to as the −B direction. In the present embodiment, the B direction is a direction inclined so that the −B direction side is located on the +Z direction side with respect to the +B direction side, and is orthogonal to the A direction.

Figure 2:
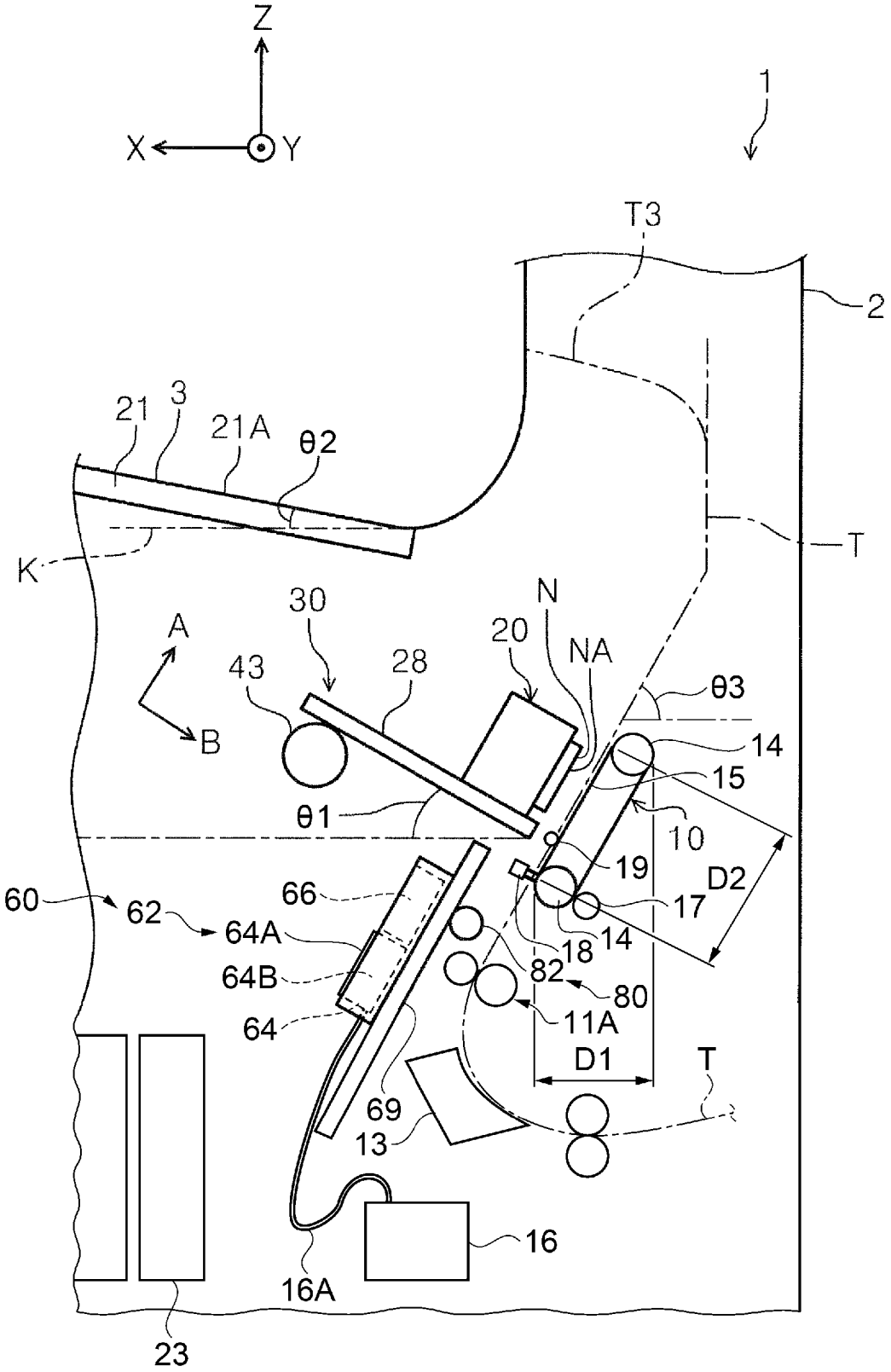
FIG. 2 is a schematic diagram illustrating a structure around a line head and a maintenance unit according to Embodiment 1.

Specifically, as illustrated in FIG. 2, when an angle formed by the B direction and the X direction is a first angle θ1 when viewed from the Y direction, the first angle θ1 is greater than 0 degrees and equal to or less than 45 degrees, specifically greater than 10 degrees and equal to or less than 40 degrees, and more specifically 30 degrees. In addition, when an angle formed by the A direction and the X direction is a third angle θ3, the third angle θ3 is equal to or greater than 45 degrees and less than 90 degrees, specifically greater than 50 degrees and equal to or less than 80 degrees, and more specifically 60 degrees. As described above, the moving direction in which the line head 20 advances and retreats with respect to the transport unit 10, which will be described later, is an inclined direction intersecting both the horizontal direction and the vertical direction. Further, the transport direction of the medium P in an area that includes the transport unit 10 at which recording is performed by the line head 20 is an inclined direction intersecting both the horizontal direction and the vertical direction.

As illustrated in FIG. 1, the printer 1 includes a housing 2 as an example of a main body of the apparatus. It is assumed that the housing 2 is placed on a horizontal plane. A discharge portion 3 forming a space portion to which the medium P on which information has been recorded is to be discharged is formed on the +Z direction side with respect to the center of the housing 2 in the Z direction. In addition, a plurality of medium cassettes 4 are provided on the −Z direction side with respect to the center of the housing 2 in the Z direction. The medium cassette 4 is an example of a medium accommodating portion. In addition, a manual feed tray 9 is provided at the center of the housing 2 in the Z direction so as to protrude from the housing 2 in the −X direction. In other words, the manual feed tray 9 is provided on the −X direction side with respect to the transport route T. The manual feed tray 9 in which the medium P can be set is used for recording on the medium P that cannot be set in the medium cassette 4.

A plurality of medium P are stacked and accommodated in the plurality of medium cassettes 4. A pick roller 6 is provided on the −X direction side with respect to the center of the medium cassette 4 so as to be in contact with the upper surface of the medium P. The pick roller 6 is located below the discharge portion 3. The medium P accommodated in each medium cassette 4 is sent out from the medium cassette 4 toward the transport route T, which is the −X direction, by the pick roller 6. The medium P sent out by the pick roller 6 toward the transport route T is transported along the transport route T by a pair of transport rollers 7 and a pair of transport rollers 8. The transport route T is provided with a transport path T1 in which the medium P is transported from an external apparatus, and a transport path T2 which joins the transport route T from the −X direction side. The transport path T2 can transport the medium P, which is set in the manual feed tray 9, to the transport route T. The manual feed tray 9 is located on the −X direction side with respect to the position where the transport path T2 joins the transport route T. According to this, it is easy to form the transport path T2 as a route along the manual feed tray 9 with less curvature.

In addition, the transport unit 10, which will be described later, a plurality of pairs of transport rollers 11 configured to transport the medium P, a pair of resist rollers 11A configured to correct the inclination of the medium P, a pair of discharge rollers 11B, a plurality of flaps 12 configured to switch a route through which the medium P is transported, and a medium width sensor 13 configured to detect a width of the medium P in the Y direction are disposed in the transport route T.

The transport route T is curved in an area facing the medium width sensor 13, and extends obliquely upward with respect to the medium width sensor 13, that is, in the +A direction. The pair of resist rollers 11A is provided upstream of the transport unit 10 in the transport route T. The pair of resist rollers 11A is disposed on the −A direction side with respect to the transport unit 10. The pair of resist rollers 11A corrects skew of the medium P to be transported. Note that the skew of the medium P refers to a state in which the posture of the medium P is inclined with respect to the transport direction.

A transport path T3 and a transport path T4 toward the discharge portion 3 and an inversion path T5 for reversing front and back sides of the medium P are provided downstream of the transport unit 10 in the transport route T. In the transport path T3 and the transport path T4, the pair of discharge rollers 11B for discharging the medium P on which the ink has been ejected toward the discharge portion 3 is disposed. The pair of discharge rollers 11B is provided at a position on the −X direction side with respect to the discharge portion 3. The pair of discharge rollers 11B discharges the medium P in the +X direction. The medium P onto which the ink has been ejected is discharged to the discharge portion 3 and is stacked.

Further, in the housing 2, ink containers 23 configured to store ink, a waste liquid reservoir 16 capable of storing waste liquid of ink, and a controller 26 configured to control the operation of each portion of the printer 1 are provided. The ink containers 23 supply ink to the line head 20 through tubes (not illustrated). As illustrated in FIG. 2, the waste liquid reservoir 16 is coupled to a first maintenance unit 62, which will be described later, via a waste liquid tube 16A having flexibility. The waste liquid reservoir 16 is located below the first maintenance unit 62. The waste liquid reservoir 16 collects the ink ejected from the line head 20 toward the first maintenance unit 62, which will be described later, for maintenance via the waste liquid tube 16A, and stores the collected ink as waste liquid.

The controller 26 includes a central processing unit (CPU), a read only memory (ROM), a random access memory (RAM), and a storage, which are not illustrated, and controls transport of the medium P in the printer 1 and the operation of recording information on the medium P by the line head 20.

As illustrated in FIG. 2, the discharge portion 3 is provided with a discharge tray 21 in accordance with the transport path T3 and the transport path T4. The discharge tray 21 configuring a bottom portion of the discharge portion 3 is a member formed in a plate shape as an example of a mounting member, and has a mounting surface 21A on which the discharged medium P is mounted. Further, the discharge tray 21 is provided downstream of the transport unit 10, which will be described later, in the transport route T for the medium P and on the +Z direction side with respect to the line head 20, which will be described later, in the Z direction.

Specifically, the discharge tray 21 extends in an oblique direction such that a portion on the +X direction side is located on the +Z direction side with respect to a portion on the −X direction side. In other words, in the transport direction of the medium P, a downstream end portion of the discharge tray 21 is located on the +Z direction side with respect to an upstream end portion. The mounting surface 21A has an inclination obliquely upward along a discharge direction of the medium P.

In FIG. 2, an angle formed by the inclination direction of the mounting surface 21A and the X direction when viewed from Y direction is a second angle θ2. The second angle θ2 is expressed as an angle formed by the mounting surface 21A and a virtual plane K along the X direction. In the present embodiment, the second angle θ2 is smaller than the first angle θ1 as an example.

The printer 1 includes, as main portions, the transport unit 10 that transports the medium P, the line head 20 that records information on the medium P, and a head moving portion 30 that moves the line head 20 in the B direction.

As illustrated in FIGS. 1 and 2, the transport unit 10 includes two pulleys 14, an endless transport belt 15 wound around the two pulleys 14, and a motor (not illustrated) configured to drive the pulleys 14. The transport unit 10 is an example of a support portion. A support surface of the transport belt 15 supporting the medium P configures a part of the transport route T. As illustrated in FIG. 2, an outer dimension D1 in the X direction of the transport belt 15 wound around the two pulleys 14 is smaller than a dimension D2 in the A direction of the support surface of the transport belt 15 that supports the medium P. In other words, of the outer dimensions in the horizontal direction of the transport belt 15 wound around the two pulleys 14, the outer dimension D1 in the direction orthogonal to the width direction of the transport belt 15 is smaller than the dimension D2 in the A direction of the support surface of the transport belt 15 that supports the medium P. The medium P is transported to a position facing the line head 20 while being attracted to the support surface of the transport belt 15. Accordingly, as illustrated in FIG. 2, a charging roller 17 for charging the transport unit 10 and a static elimination brush 18 for eliminating static electricity from the medium P supported by the transport unit 10 are provided in the housing 2.

The charging roller 17 is an example of a charging portion. The charging roller 17 is brought into contact with the transport belt 15 to charge the transport belt 15. The charging roller 17 charges the transport belt 15 to attract the medium P to the support surface of the transport belt 15. The charging roller 17 is provided at a position on the +B direction side with respect to the endless transport belt 15 wound around the two pulleys 14. The charging roller 17 may be provided at a position where the transport belt 15 is pinched between the charging roller 17 and the pulley 14 located on the −A direction side of the two pulleys 14.

The charging roller 17 is in contact with the support surface of the transport belt 15, and is driven to rotate in accordance with the operation of the transport belt 15. A power supply device (not illustrated) that applies a DC voltage to the charging roller 17 is coupled to the charging roller 17, whereby the charging roller 17 supplies electric charge to a contact portion of the transport belt 15. The power supply device is controlled by the controller 26 to switch the voltage applied to the charging roller 17 on and off and to switch the voltage applied to the charging roller 17. Note that, in the present embodiment, the charging roller 17 supplies positive charges to the transport belt 15, and charges the support surface of the transport belt 15 with a positive polarity.

The static elimination brush 18 is an example of a static elimination portion. The static elimination brush 18 eliminates static electricity from the medium P by coming into contact with the medium P supported by the transport belt 15. The static elimination brush 18 is provided at a position on the −B direction side with respect to the endless transport belt 15 wound around the two pulleys 14. The static elimination brush 18 is provided at a position on the −A direction side with respect to an ejecting surface NA of the line head 20. The static elimination brush 18 may be provided at a position where the transport belt 15 is pinched between the static elimination brush 18 and the pulley 14 located on the −A direction side of the two pulleys 14.

The static elimination brush 18 removes the electric charge on the recording surface which is the ejecting surface NA side of the medium P. Alternatively, the static elimination brush 18 may remove the electric charge on the support surface of the transport belt 15. In more detail, when the electric charge is applied to the support surface of the transport belt 15 by the charging roller 17, in the medium P in contact with the support surface, an electric charge having an opposite polarity is generated on the surface in contact with the support surface, and an electric charge having the opposite polarity to the electric charge is also generated on the opposite side of the medium P, that is, the recording surface. The electric charge on the recording surface side is removed by the static elimination brush 18. Accordingly, only the electric charge on the side in contact with the transport belt 15 remains on the medium P, and as a result, the medium P is attracted to the support surface.

The static elimination brush 18 may be made of any material capable of removing charges from the medium P and the transport belt 15, and may be formed of, for example, a resin material such as conductive nylon. The static elimination brush 18 is coupled to a switching device (not illustrated), and the switching device is controlled by the controller 26 to switch between a state in which the static elimination brush 18 is grounded and a state in which the static elimination brush 18 is not grounded.

As described above, the transport belt 15 supports the medium P while attracting the medium P. The support surface of the transport belt 15 for supporting the medium P configures an area of the transport route T that faces the line head 20. That is, the transport unit 10 rotates when the pulleys 14 are driven, and transports the medium P supported by the support surface of the transport belt 15 in the +A direction in the transport direction. At this time, the downstream in the transport direction is above the upstream in the transport direction. Further, the transport unit 10 is disposed so as to face the line head 20 in the B direction. As a method of attracting the medium P on the transport belt 15, an attracting method such as an air suction method may be adopted.

The transport unit 10 may further include a driven roller 19 that suppresses the floating of the medium P from the support surface of the transport belt 15. In this case, the driven roller 19 is provided at a position on the −B direction side with respect to the endless transport belt 15 wound around the two pulleys 14. The driven roller 19 is provided at a position between the ejecting surface NA of the line head 20 and the static elimination brush 18 in the A direction. The driven roller 19 is provided at a position where the medium P is pinched between the driven roller 19 and the transport belt 15, and is driven to rotate in accordance with the movement of the medium P supported by the transport belt 15. Note that the driven roller 19 may be made of a conductive material such as metal and may be grounded.

The line head 20 is an example of a head portion. Further, the line head 20 has nozzles N configured to eject ink as an example of the liquid. Additionally, the line head 20 is disposed so as to face the transport unit 10 in the B direction at a recording position, which will be described later, and records information by ejecting the ink from the nozzles N to the medium P transported in the transport direction. The line head 20 is an ink ejecting head that is configured such that the nozzles N configured to eject the ink to cover the entire area in the Y direction as the width direction of the medium P. Further, the ejecting surface NA on which the nozzles N are arranged is disposed along the A direction and the Y direction. As illustrated in FIG. 2, the ejecting surface NA faces in the +B direction. In the ejecting surface NA, the dimension of the ejecting surface NA in the Y direction is larger than the dimension of the ejecting surface NA in the A direction. The ejecting surface NA, in the A direction, faces a portion of the support surface of the transport belt 15 for supporting the medium P on the +A direction side with respect to the center of the support surface. That is, the line head 20 is, in the A direction, located on the +A direction side with respect to the center of the support surface of the transport belt 15 for supporting the medium P.

Further, the line head 20 is configured as the ink ejecting head that can perform recording on the entire area in the width direction of the medium P without moving in the width direction of the medium P. However, the ink ejecting head is not limited to this type, and may be a type that is mounted on a carriage and ejects ink while moving in the width direction of the medium P.

Figure 4:
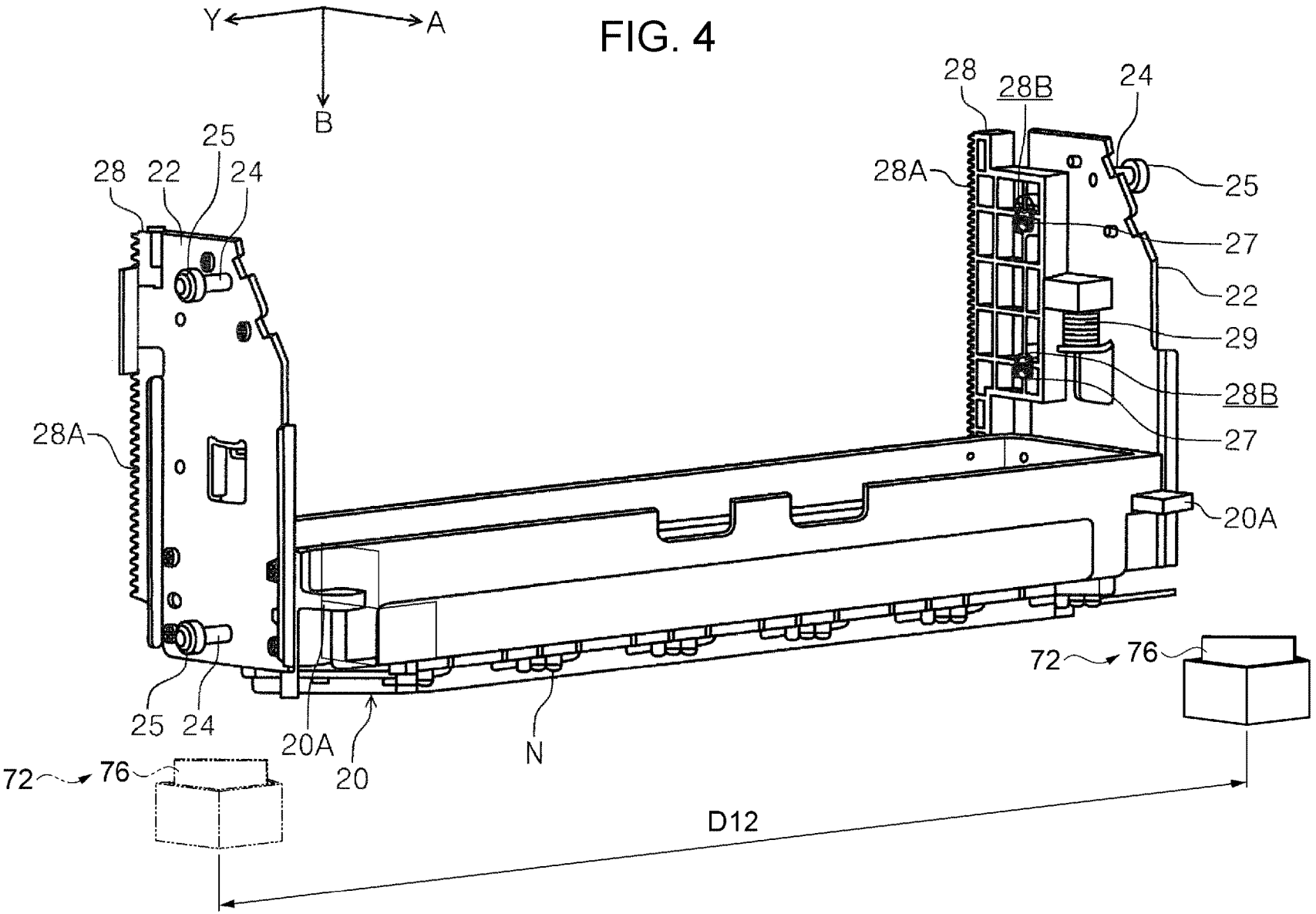
FIG. 4 is an enlarged perspective view of the line head according to Embodiment 1.

As illustrated in FIG. 4, the line head 20 extends in the Y direction. Plate portions 20A protrude toward the +A direction from a side portion on the +A direction side at both end portions of the line head 20 in the Y direction. Further, a support frame 22 is attached to each of both end portions of the line head 20 in the Y direction. A second maintenance unit 72 illustrated in FIG. 4 will be described later.

The support frames 22 are configured as side plates along an A-B plane, and extend in the −B direction with respect to the line head 20. Columnar support pins 24 are provided at both end portions in the B direction on outer surfaces of the support frames 22 in the Y direction, and extend in the +Y direction and the −Y direction, respectively. An annular roller 25 is rotatably provided on the support pin 24.

Further, on an inner surface of the support frame 22 in the Y direction, support pins 27, a rack 28, and a coil spring 29 are provided. The support pins 27 protrude in the Y direction from the support frame 22.

The rack 28 is a plate-shaped member having a thickness direction in the Y direction, and extends in the B direction. A plurality of tooth portions 28A arranged in the B direction is formed on an end portion of the rack 28 in the −A direction. Further, the rack 28 has elongated holes 28B each of which passes through in the Y direction and extends in the B direction. The support pin 27 is inserted into the elongated hole 28B. Accordingly, the rack 28 can relatively move with respect to the support frame 22 in the B direction.

One end portion of the coil spring 29 is attached to the support frame 22. Another end portion of the coil spring 29 is attached to the rack 28. As a result, the coil spring 29 applies elastic force to the rack 28 in the B direction.

Figure 3:
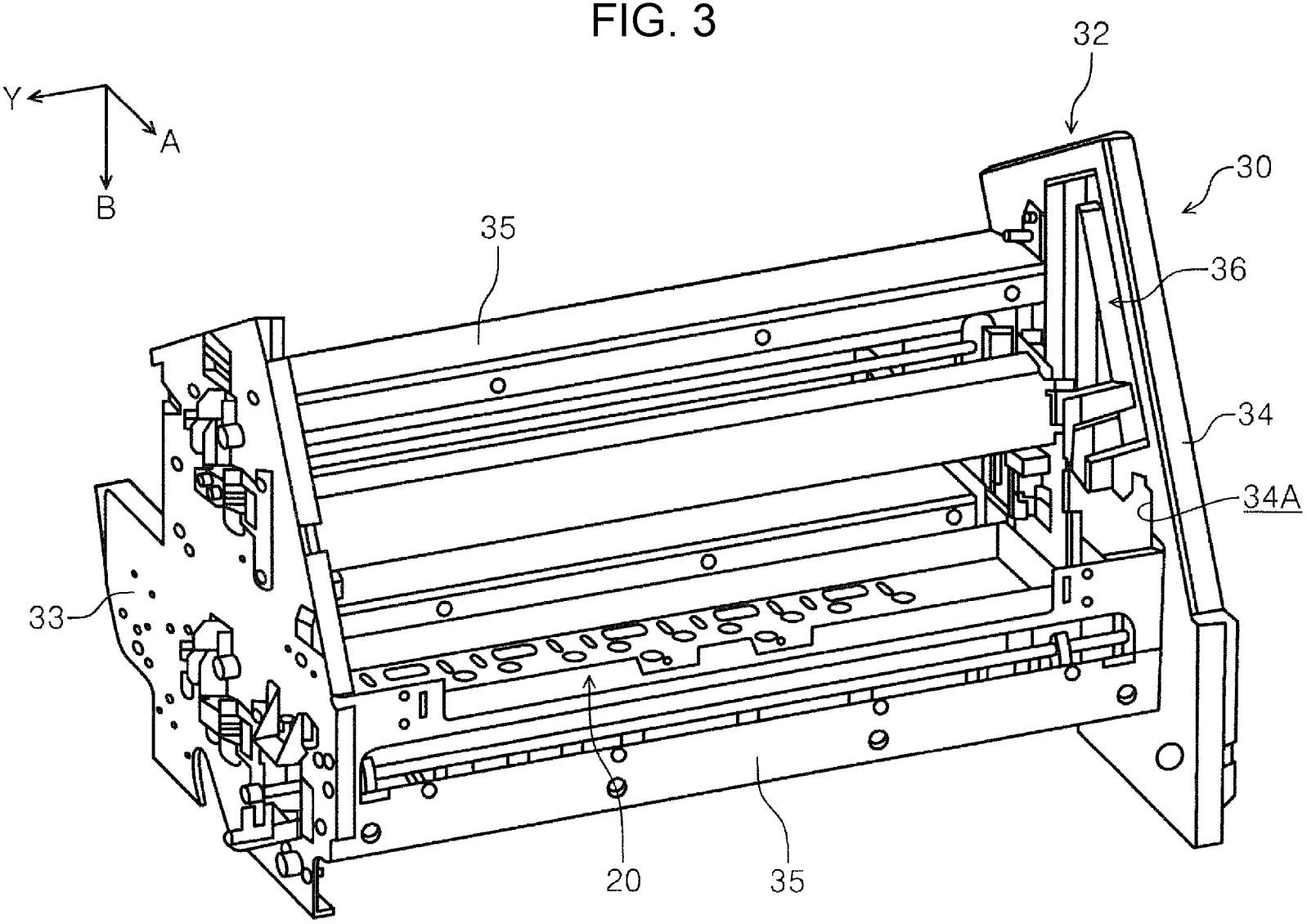
FIG. 3 is a perspective view illustrating a structure around the line head according to Embodiment 1.

The line head 20 is detachable from the head moving portion 30 illustrated in FIG. 3 at a replacement position drawn by the two-dot chain line in FIG. 1. The replacement position is a position farthest from the transport unit 10 in the −B direction in the moving direction of the line head 20. Specifically, the line head 20 is configured to be detached from the head moving portion 30 by moving the support frames 22 in the −B direction along guide rails 37, which will be described later, and further pulling up the support frames 22 in the +Z direction along guide rails 38.

The head moving portion 30 moves the line head 20 to a recording position and a retreat position, which will be described later, along the B direction. In other words, the head moving portion 30 moves the line head 20 in the B direction such that the moving direction of the line head 20 intersects both the vertical direction and the horizontal direction. In addition, the moving direction is an inclined direction that intersects the horizontal plane at an angle greater than 0 degrees and 45 degrees or less. Specifically, the angle at which the moving direction intersects the horizontal plane is 30 degrees.

Figure 5:
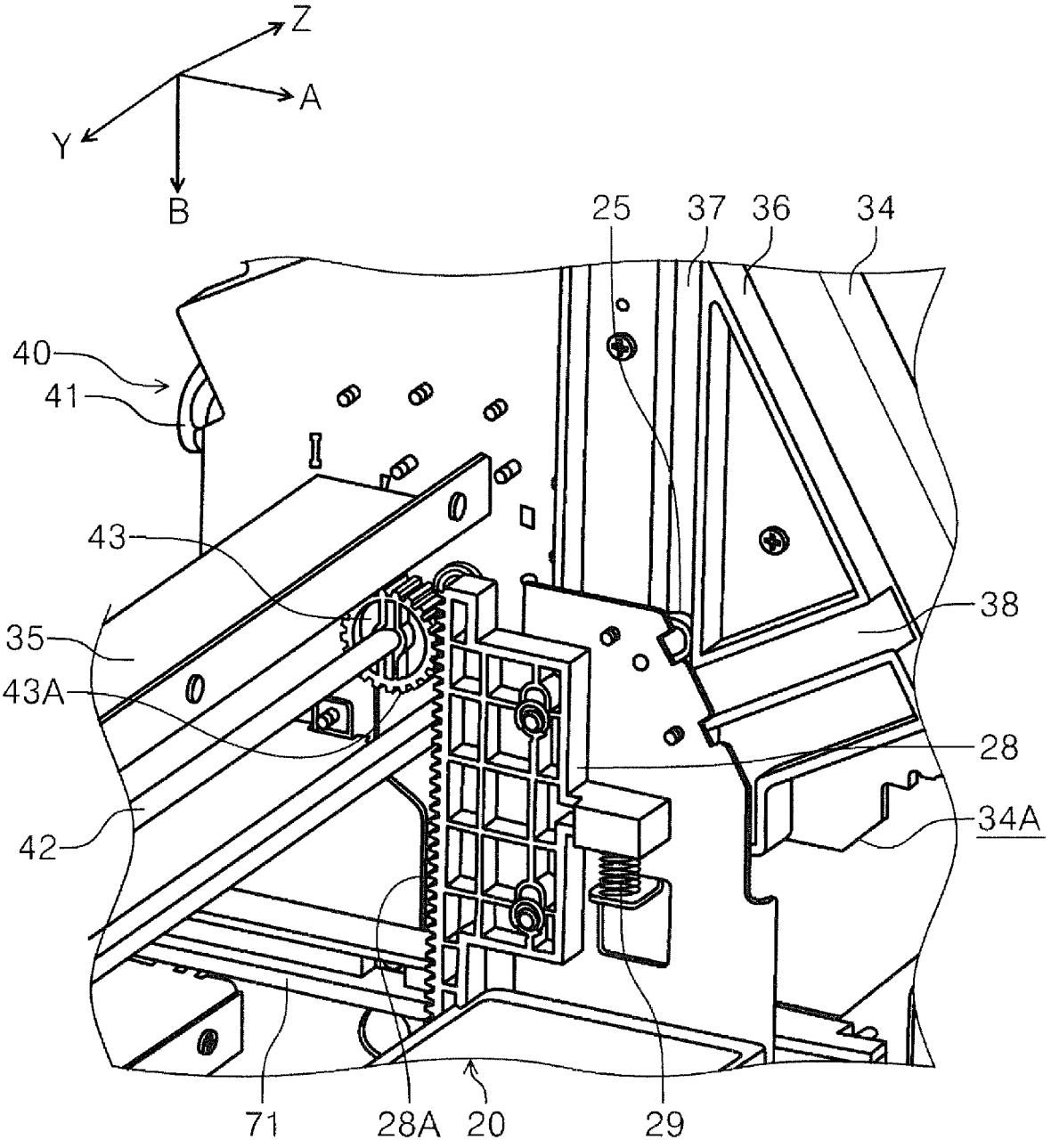
FIG. 5 is an enlarged perspective view of a part of the line head and a main body frame according to Embodiment 1.

As illustrated in FIGS. 3 and 5, the head moving portion 30 includes a main body frame 32 configuring a main body, guide members 36 configured to guide the line head 20 in the B direction, and a drive unit 40 configured to drive the line head 20, which will be described later, in the B direction. Then, the head moving portion 30 moves the line head 20 to one or more retreat positions, which will be described later, away from the transport unit 10 with respect to the recording position, which will be described later. Specifically, the head moving portion 30 is provided so that the line head 20 can be moved to a first position, a second position, and a third position. Note that the first position, the second position, and the third position will be described later.

The main body frame 32 is included in the housing 2. That is, the main body frame 32 is included in an example of the main body of the apparatus. Specifically, the main body frame 32 has a side frame 33, a side frame 34, and a plurality of lateral frames 35.

The side frame 33 and the side frame 34 are respectively configured as side plates along the A-B plane, and are arranged so as to face each other at a distance in the Y direction. The side frame 33 is arranged on the +Y direction side, and the side frame 34 is arranged on the −Y direction side. The side frame 34 is formed with a through-hole 34A for moving a second maintenance unit 72, which will be described later. The plurality of lateral frames 35 couples the side frame 33 and the side frame 34 in the Y direction. In addition, the line head 20 is disposed in a space surrounded by the plurality of lateral frames 35.

The guide member 36 is an example of a guide portion, and one guide member 36 is provided on each of the side frame 33 and the side frame 34. Note that the two guide members 36 are substantially symmetrically arranged with respect to the center of the main body frame 32 in the Y direction. For this reason, the guide member 36 in the −Y direction will be described, and description of the guide member 36 in the +Y direction will be omitted.

As illustrated in FIG. 5, the guide member 36 is attached to the side surface of the side frame 34 in the +Y direction. The guide rail 37 extending in the B direction, and the guide rail 38 branching from a middle portion of the guide rail 37 and extending in the Z direction are formed on the guide member 36. Each of the guide rail 37 and the guide rail 38 is a groove opening in the +Y direction. Further, the guide rail 37 and the guide rail 38 guide the rollers 25 in the B direction and the Z direction, respectively.

As illustrated in FIG. 5, the side frame 34 is provided with a guide rail 71 that configures a cap moving portion 80, which will be described later. The guide rail 71 is also provided on the side frame 33. That is, one pair of guide rails 71 is provided between the side frame 33 and the side frame 34. The one pair of guide rails 71 is formed in a groove shape opening inside in the Y direction, and extends along the A direction. Further, the one pair of guide rails 71 supports a plurality of rollers 73, which will be described later, so as to be movable in the A direction. That is, the one pair of the guide rails 71 guides the plurality of rollers 73 in the A direction, so that the first maintenance unit 62, which will be described later, can move in the A direction.

As illustrated in FIG. 5, the drive unit 40 includes a motor 41, a gear portion (not illustrated), a shaft 42, and pinions 43, and the drive is controlled by the controller 26. The shaft 42 extends in the Y direction. Both end portions of the shaft 42 are rotatably supported by the side frame 33 and the side frame 34 illustrated in FIG. 3. The pinion 43 is attached to each of both end portions of the shaft 42 in the Y direction. Tooth portions 43A configured to engage with the tooth portions 28A are formed on an outer peripheral portion of the pinion 43.

The motor 41 rotates the shaft 42 and the pinions 43 in one direction or in the reverse direction via the gear portion (not illustrated). As described above, the drive unit 40 rotationally drives the pinions 43, thereby moving the line head 20 in the B direction.

Figure 6:
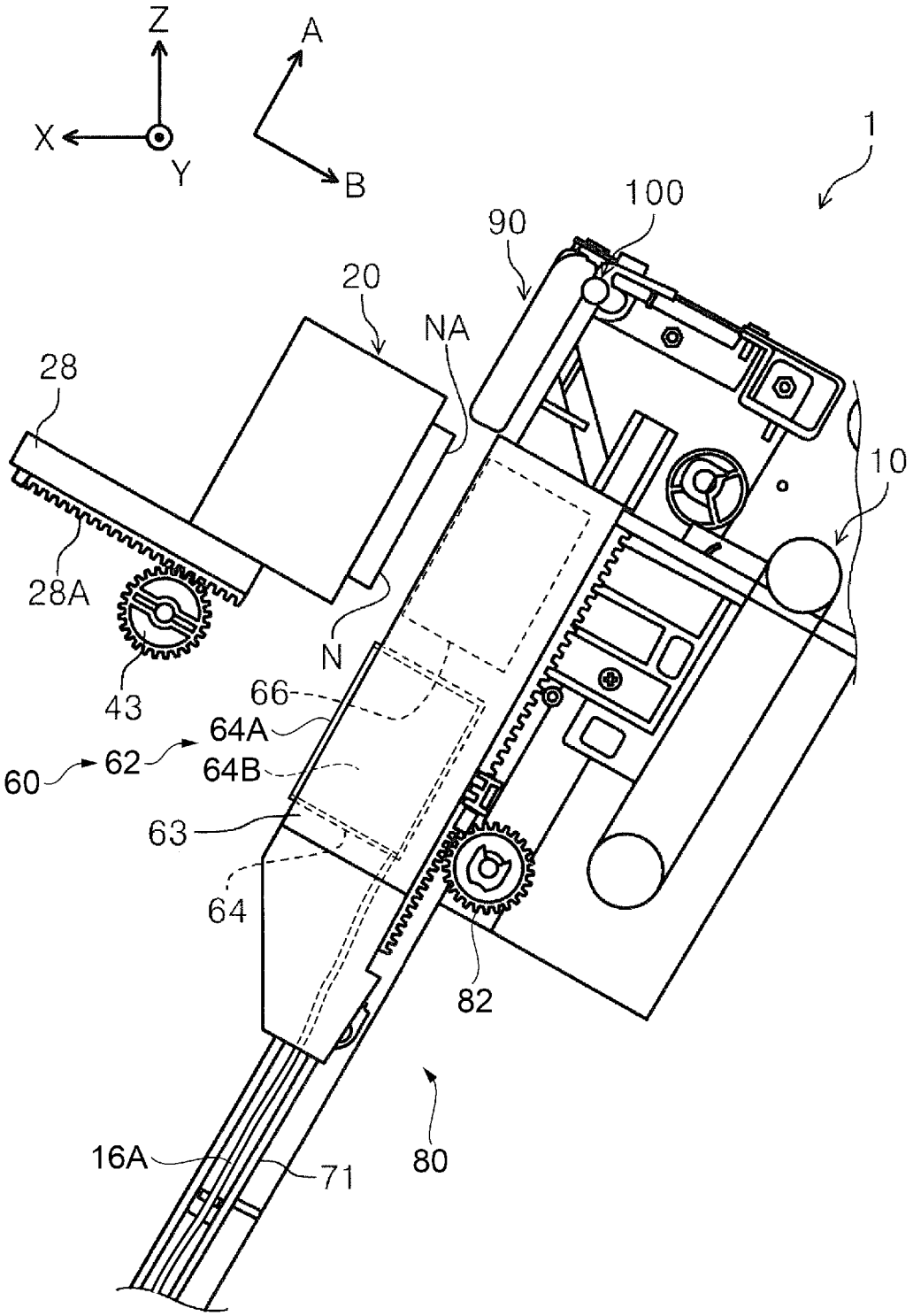
FIG. 6 is a diagram illustrating arrangement of the line head and the maintenance unit according to Embodiment 1.

As illustrated in FIG. 6, the printer 1 includes the maintenance unit 60, the cap moving portion 80, a lid unit 90, and a rotation mechanism portion 100.

The maintenance unit 60 is an example of a storage portion that stores the nozzles N and that performs maintenance of the nozzles N. Specifically, the maintenance unit 60 includes the first maintenance unit 62 capable of covering the nozzles N and the second maintenance unit 72 configured to clean the nozzles N by wiping the ink ejecting surface NA of the nozzles N. The second maintenance unit 72 will be described later.

The first maintenance unit 62 is an example of the cap portion. Further, the first maintenance unit 62 includes a cap portion main body 63, a cap 64 configured to cover the nozzles N, and a flushing portion 66 configured to face the nozzles N and receive ink ejected from the nozzles N. Further, the first maintenance unit 62 is provided with the cap 64 and the flushing portion 66 along the A direction, and moves in the A direction to switch between a state in which the cap 64 faces the nozzles N and a state in which the flushing portion 66 faces the nozzles N. Further, the first maintenance unit 62 has a standby position on the −A direction side with respect to the line head 20, and has the standby position, an ejecting position, and a cap position in order toward the +A direction.

The standby position is apart from the cap position in the −A direction in the A direction. That is, the standby position is apart from the line head 20 with respect to the cap position, and is positioned below the cap position. According to this, it is easy to dispose the waste liquid tube 16A, which couples the first maintenance unit 62 and the waste liquid reservoir 16, below the line head 20. Therefore, the waste liquid tube 16A is unlikely to interfere with the line head 20 and the transport route T. Further, since the waste liquid tube 16A is unlikely to be bent at the cap position, the waste liquid from the first maintenance unit 62 can be easily collected in the waste liquid reservoir 16.

The ejecting position is a position of the first maintenance unit 62 when the flushing portion 66 faces the nozzles N. The ejecting position is apart from the standby position in the +A direction in the A direction. The cap position is a position of the first maintenance unit 62 when the cap 64 covers the ejecting surface NA. The first maintenance unit 62 at the cap position is located between the line head 20 and the transport unit 10 in the B direction. The cap position is apart from the ejecting position in the −A direction in the A direction.

Figure 7:
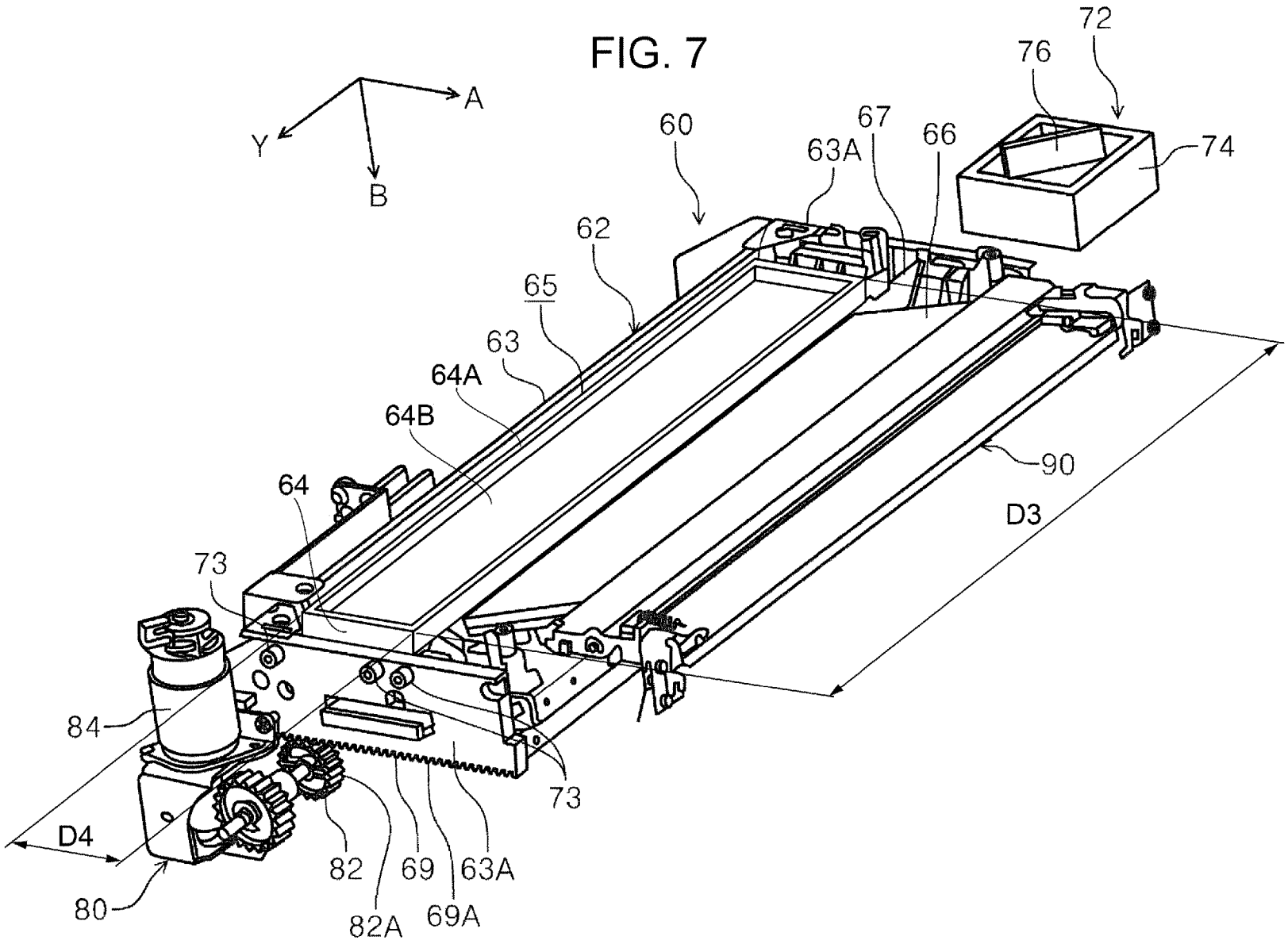
FIG. 7 is a perspective view of the maintenance unit according to Embodiment 1.

As illustrated in FIG. 7, the cap portion main body 63 is formed in a box shape in which the dimension in the Y direction is larger than the dimension in the A direction. The cap portion main body 63 is formed with an opening 65 that opens in the −B direction. Of the cap portion main body 63, a rack 69 extending in the A direction is provided on each of a side wall 63A in the +Y direction and a side wall 63A in the −Y direction. The rack 69 has a plurality of tooth portions 69A aligned in the A direction. In addition, on both the side walls 63A, a plurality of rollers 73 each of which is rotatable about the Y direction serving as an axis direction is provided. A partition wall 67 is provided inside the cap portion main body 63. The partition wall 67 partitions a space in the cap portion main body 63 into a space in the +A direction and a space in the −A direction. The cap 64 is arranged in the space in the −A direction of the partition wall 67, and the flushing portion 66 is arranged in the space in the +A direction of the partition wall 67.

The cap 64 of the first maintenance unit 62 has a cap surface 64A that covers the ejecting surface NA. The cap 64 includes a recessed portion 64B that opens to the cap surface 64A. The cap surface 64A has a size and a shape capable of covering the ejecting surface NA. Therefore, when the cap surface 64A at the cap position is viewed from the −B direction side, a dimension D3 of the cap surface 64A in the Y direction is larger than a dimension D4 of the cap surface 64A in the A direction. Further, when the first maintenance unit 62 at the cap position is viewed from the B direction, the dimension of the first maintenance unit 62 in the Y direction is larger than the dimension of the first maintenance unit 62 in the A direction. Here, the standby position of the first maintenance unit 62 is provided at a position spaced apart from the cap position in the A direction. According to this, the distance between the standby position and the cap position can be narrowed as compared with a case where the standby position is provided at a position spaced apart from the cap position in the Y direction, and the installation area of the printer 1 can be easily reduced.

Further, the cap 64 covers the ejecting surface NA by disposing the cap surface 64A facing the ejecting surface NA in the B direction. That is, at the cap position, the first maintenance unit 62 covers the ejecting surface NA, so that drying of the nozzles N is suppressed and an increase in viscosity of the ink is suppressed. Note that the cap 64 can cover the nozzles N when the line head 20 is located at the retreat position. That is, the first maintenance unit 62 does not cover the ejecting surface NA at the standby position and the ejecting position.

The flushing portion 66 is an example of a receiving portion, and is provided in the opening 65. Further, the flushing portion 66 is disposed on the +A direction side with respect to the cap 64 in the A direction. In other words, in a state where the first maintenance unit 62 is disposed at the standby position, the flushing portion 66 is disposed at a position closer to the line head 20 than the cap 64 in the A direction.

Further, the flushing portion 66 is configured as a flushing box that is opened in the −B direction and that has porous fibers such as felt. Then, the flushing portion 66 captures the ink ejected from the nozzles N. In the nozzles N, when the viscosity of the ink increases, the viscosity of the ink is maintained within a set range by ejecting the ink toward the flushing portion 66. Accordingly, poor ejection of the ink ejected from the nozzles N is suppressed.

The second maintenance unit 72 is an example of a cleaning portion. The second maintenance unit 72 includes a main body portion 74 and a blade 76. The main body portion 74 is formed in a box shape that opens in the −B direction. The blade 76 is made of, as an example, rubber having a rectangular plate shape. Further, the blade 76 is provided in the main body portion 74 in a state where a portion that wipes the nozzles N protrudes in the −B direction from the main body portion 74, and is inclined with respect to the A direction and the Y direction.

The second maintenance unit 72 is configured to be advanced and retreated by a blade moving portion (not illustrated) in the Y direction between a retreat position in the −Y direction with respect to the side frame 34 and a cleaning position for cleaning the ejecting surface NA. The Y direction is an example of a second direction in which the blade moving portion advances and retreats the second maintenance unit 72. A maximum movement amount D12 of the second maintenance unit 72 in the Y direction is a distance in the Y direction between the retreat position drawn by the solid line and a position drawn by the two-dot chain line farthest from the retreat position in FIG. 4. The second maintenance unit 72 at the cleaning position is located between the line head 20 and the transport unit 10 in the B direction. The drive unit (not illustrated) includes, as an example, a motor and a belt to which the second maintenance unit 72 are attached, and is configured to move the second maintenance unit 72 in the Y direction by moving the belt circularly by the rotation of the motor. Note that the second maintenance unit 72 is retreated to the retreat position when the first maintenance unit 62 covers the line head 20 or when the line head 20 performs recording.

The cap moving portion 80 moves the first maintenance unit 62 in the A direction between the cap position and the standby position. The A direction is an example of a first direction in which the cap moving portion 80 advances and retreats the first maintenance unit 62. The first direction is an inclined direction intersecting the horizontal plane at an angle of 45 degrees or more and less than 90 degrees and specifically, the angle at which the first direction intersects the horizontal plane is 60 degrees. Therefore, the first direction has a larger inclination with respect to the horizontal plane than the moving direction. As illustrated in FIG. 2, the cap moving portion 80 moves the first maintenance unit 62 on the −B direction side with respect to the static elimination brush 18. According to this, it is possible to narrow the distance between the pair of resist rollers 11A and the line head 20 in the A direction. Thus, it is possible to perform recording by the line head 20 on the medium P having less skew after passing through the pair of resist rollers 11A. Further, the cap moving portion 80 moves the first maintenance unit 62 in the A direction on the −B direction side with respect to the pair of resist rollers 11A. The cap moving portion 80 supports the first maintenance unit 62 in a state in which the cap surface 64A of the cap 64 faces in the −B direction. A state facing in the −B direction is an example of a state facing in the direction between the X direction and the +Z direction. Specifically, the cap moving portion 80 includes a gear 82 having tooth portions 82A configured to engage with the tooth portions 69A of the rack 69, a motor 84 configured to rotate the gear 82, and the one pair of guide rails 71 illustrated in FIG. 6 that supports the plurality of rollers 73 of the first maintenance unit 62. The drive control of the cap moving portion 80 is performed by the controller 26.

When the line head 20 is located at the retreat position, which will be described later, the cap moving portion 80 advances the first maintenance unit 62 between the line head 20 at the retreat position and the transport unit 10. In addition, the cap moving portion 80 retreats the first maintenance unit 62 in the −A direction from between the line head 20 at the retreat position and the transport unit 10 before the line head 20 is located at the recording position, which will be described later.

The lid unit 90 is an example of a lid portion. The lid unit 90 is formed in a rectangular parallelepiped shape that is long in the Y direction as a whole, and is rotatable about a rotation axis extending in the Y direction. The lid unit 90 is located on the +A direction side with respect to the line head 20 in the A direction at the ejecting position. When the cap 64 covers the nozzles N, the lid unit 90 takes a closed posture in which the lid unit 90 covers the flushing portion 66.

The rotation mechanism portion 100 is a mechanism portion configured to rotate the lid unit 90 about the rotation axis. When the head moving portion 30 moves the line head 20 from the recording position to be described later to the retreat position, the rotation mechanism portion 100 rotates the lid unit 90 so that the posture of the lid unit 90 becomes the closed posture.

Next, the respective positions of the line head 20 in the B direction when the line head 20 illustrated in FIG. 2 is moved by the head moving portion 30 and the position of the maintenance unit 60 will be described.

Figure 8:
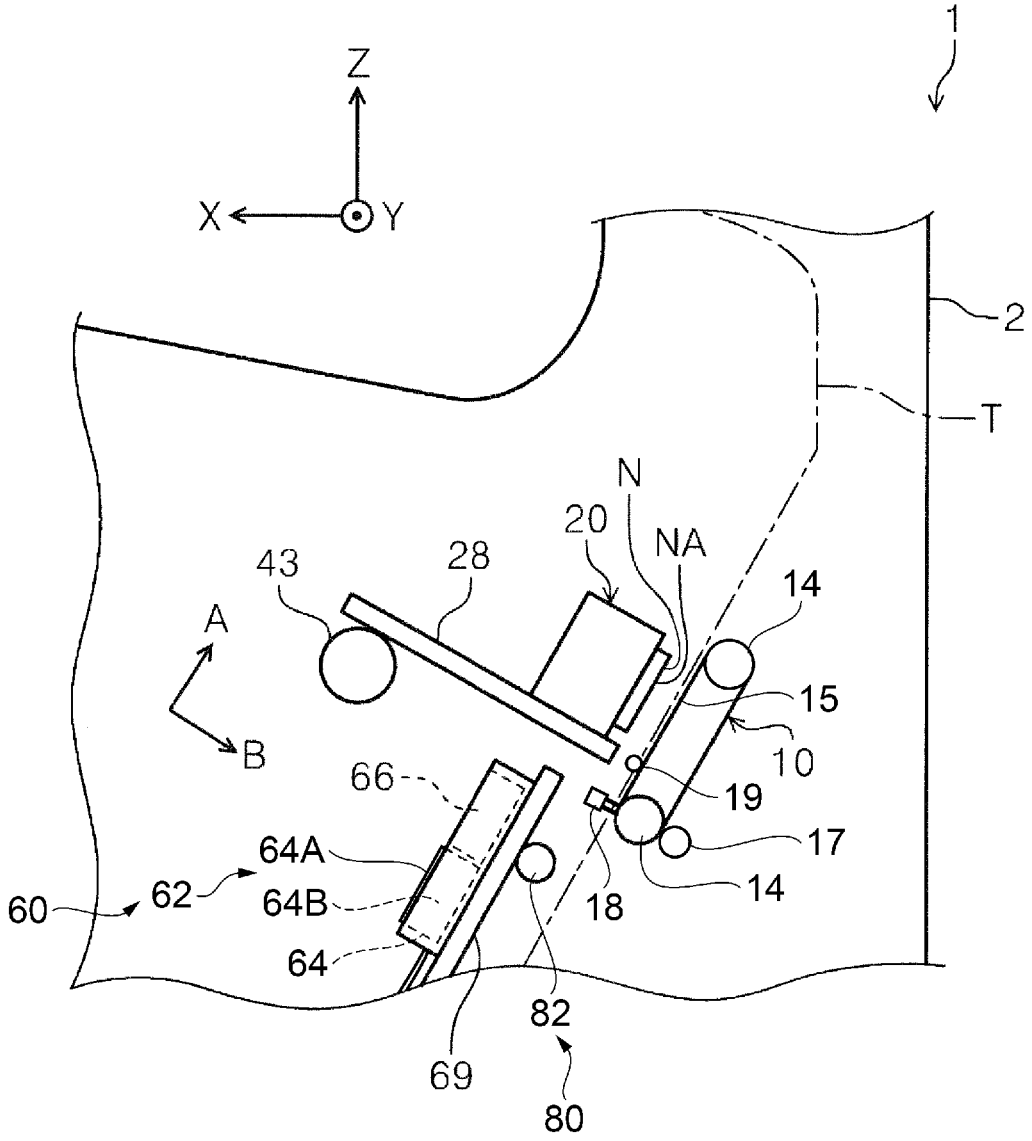
FIG. 8 is a schematic diagram illustrating a state in which the line head according to Embodiment 1 is located at a recording position.

As illustrated in FIG. 8, the recording position of the line head 20 means a stop position of the line head 20 when information can be recorded on the medium P by the line head 20. When the line head 20 is at the recording position, the first maintenance unit 62 is at the standby position, and the second maintenance unit 72 is at the retreat position.

The retreat position of the line head 20 means a stop position of the line head 20 when the line head 20 is moved away from the transport unit 10 in the −B direction with respect to the recording position. The retreat position of the line head 20 includes the first position, the second position, the third position, a head standby position, and the replacement position, which will be described later.

Figure 9:
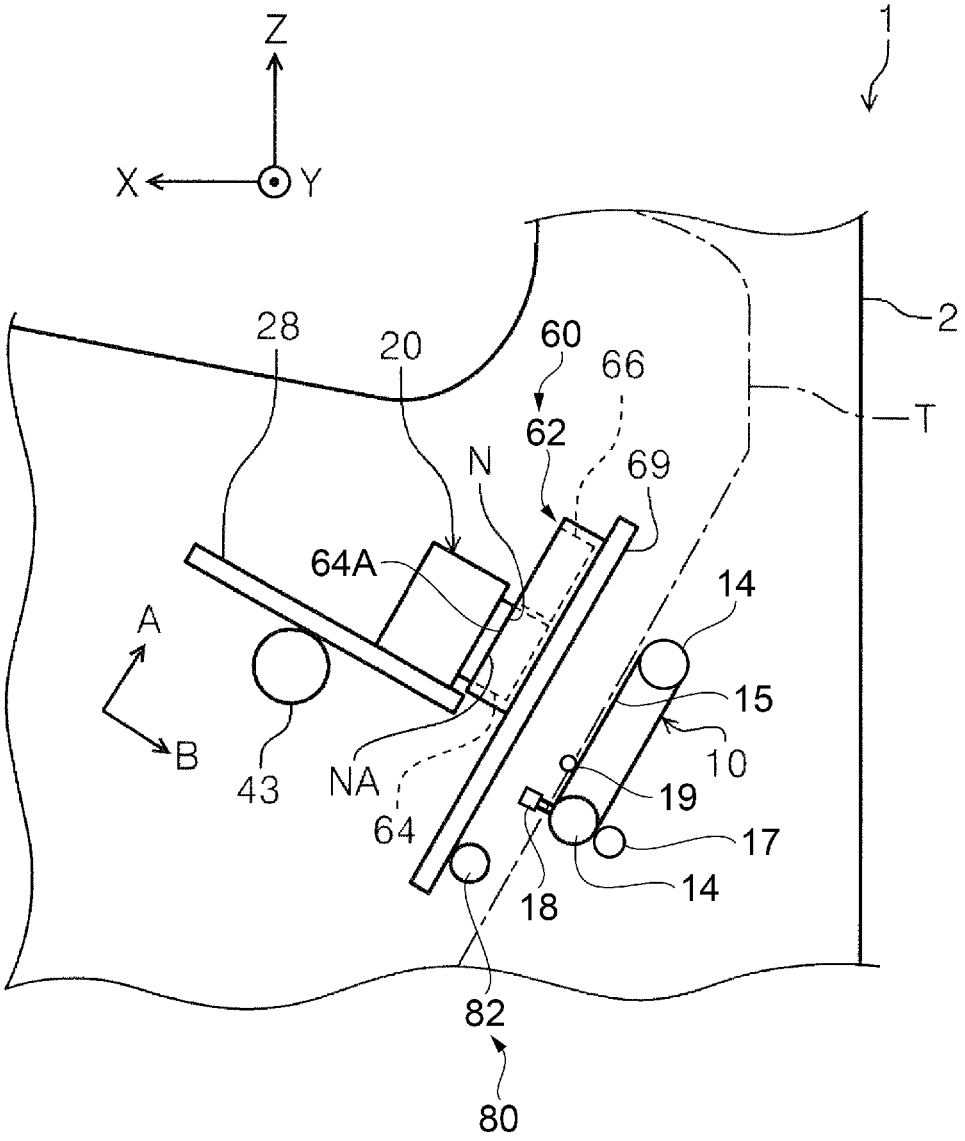
FIG. 9 is a schematic diagram illustrating a state in which the line head according to Embodiment 1 is located at a first position.

As illustrated in FIG. 9, the first position of the line head 20 means a position of the line head 20 when the first maintenance unit 62 covers the nozzles N in the B direction. When the line head 20 is at the first position, the first maintenance unit 62 is at the cap position, and the second maintenance unit 72 is at the retreat position. The line head 20 at the first position and the first maintenance unit 62 at the cap position overlap at least partially when viewed from the Z direction. Further, the first maintenance unit 62 at the cap position and the transport unit 10 overlap at least partially when viewed from the Z direction.

Figure 10:
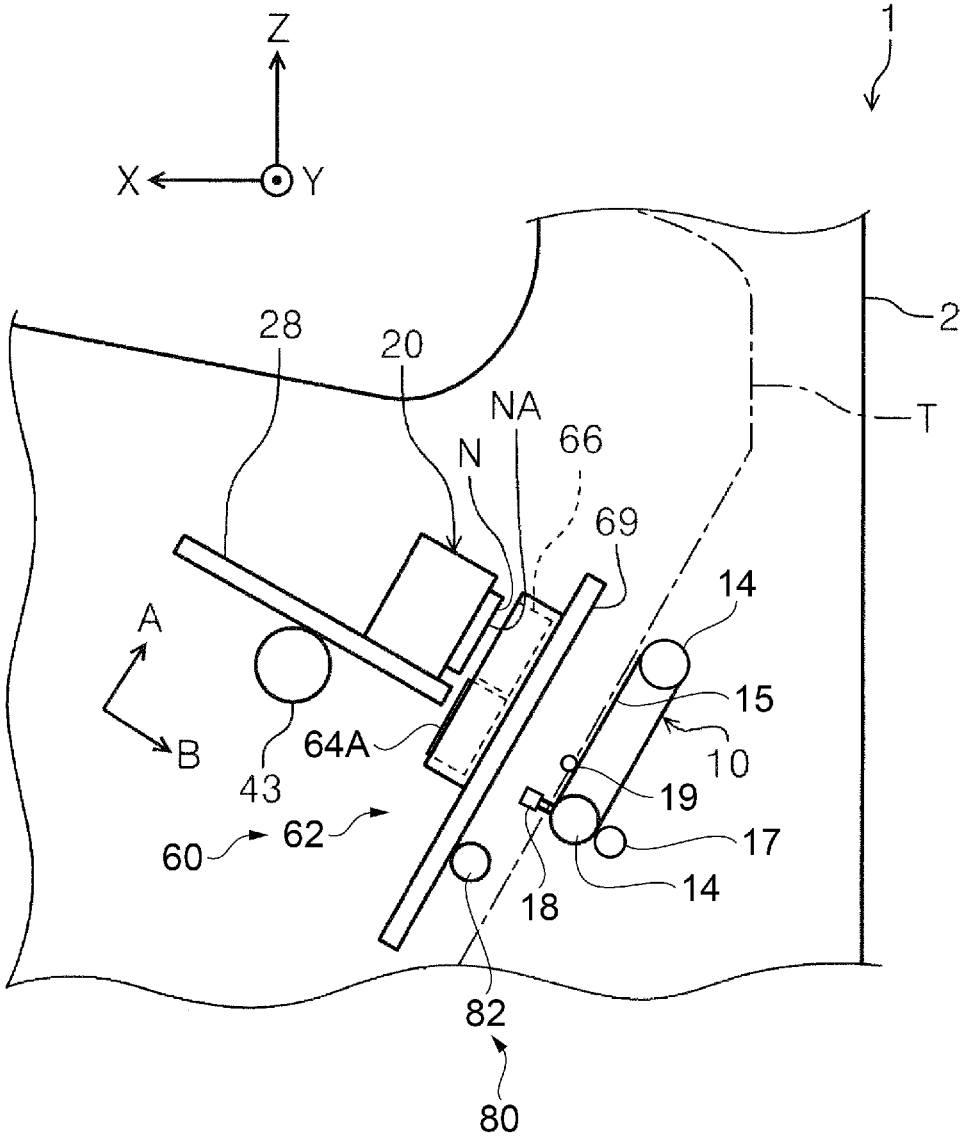
FIG. 10 is a schematic diagram illustrating a state in which the line head according to Embodiment 1 is located at a second position.

As illustrated in FIG. 10, the second position of the line head 20 means a position of the line head 20 when the nozzles N are farther from the first maintenance unit 62 than the first position and face the flushing portion 66 in the B direction. Note that, at the second position, the flushing portion 66 may be apart from the nozzles N. When the line head 20 is at the second position, the first maintenance unit 62 is at the ejecting position, and the second maintenance unit 72 is at the retreat position.

Figure 11:
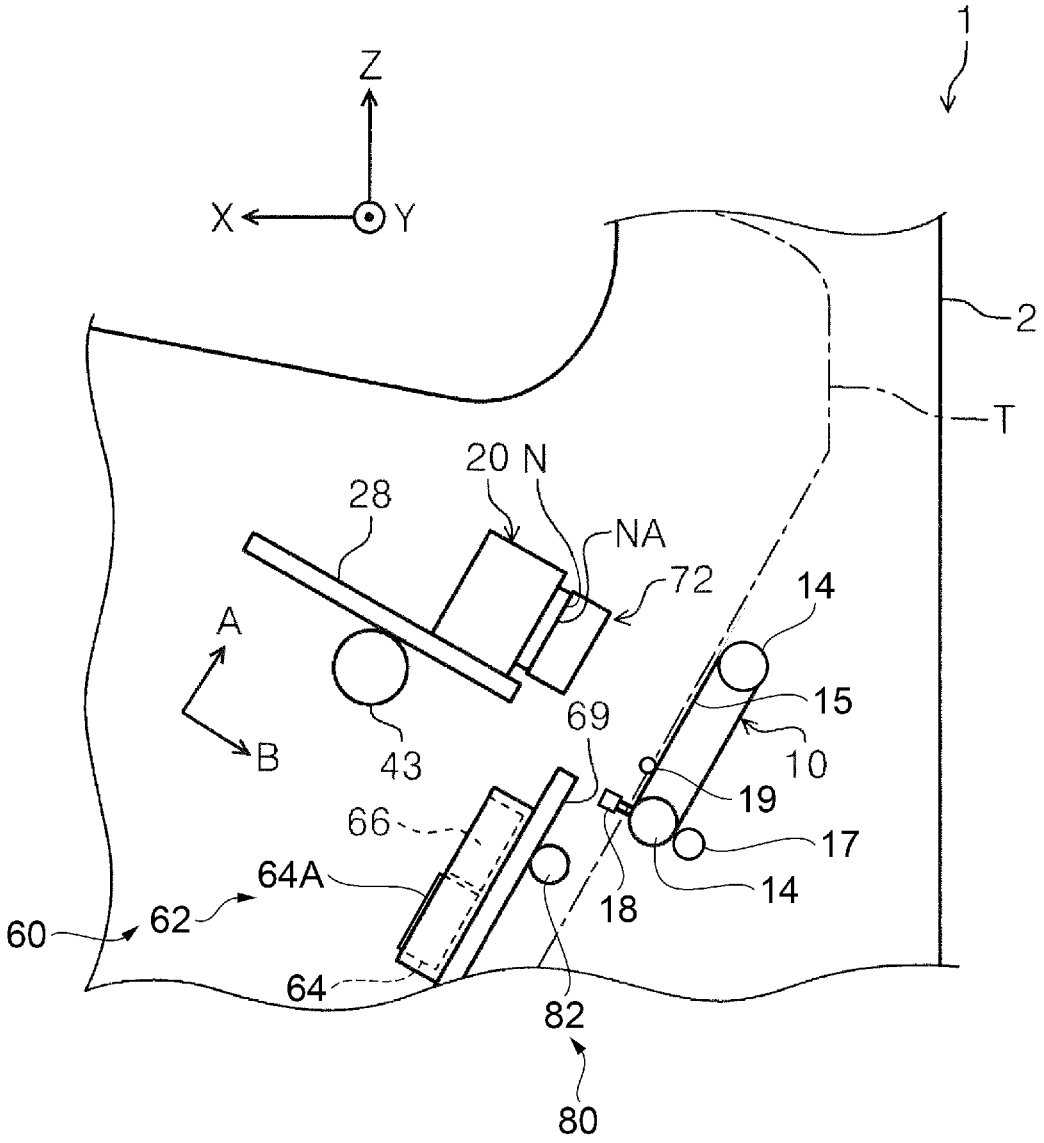
FIG. 11 is a schematic diagram illustrating a state in which the line head according to Embodiment 1 is located at a third position.

As illustrated in FIG. 11, the third position of the line head 20 means a position of the line head 20 when the second maintenance unit 72 can clean the ejecting surface NA of the nozzles N in the B direction. When the line head 20 is at the third position, the first maintenance unit 62 is at the standby position, and the second maintenance unit 72 can move in the Y direction between the retreat position and the cleaning position.

Figure 12:
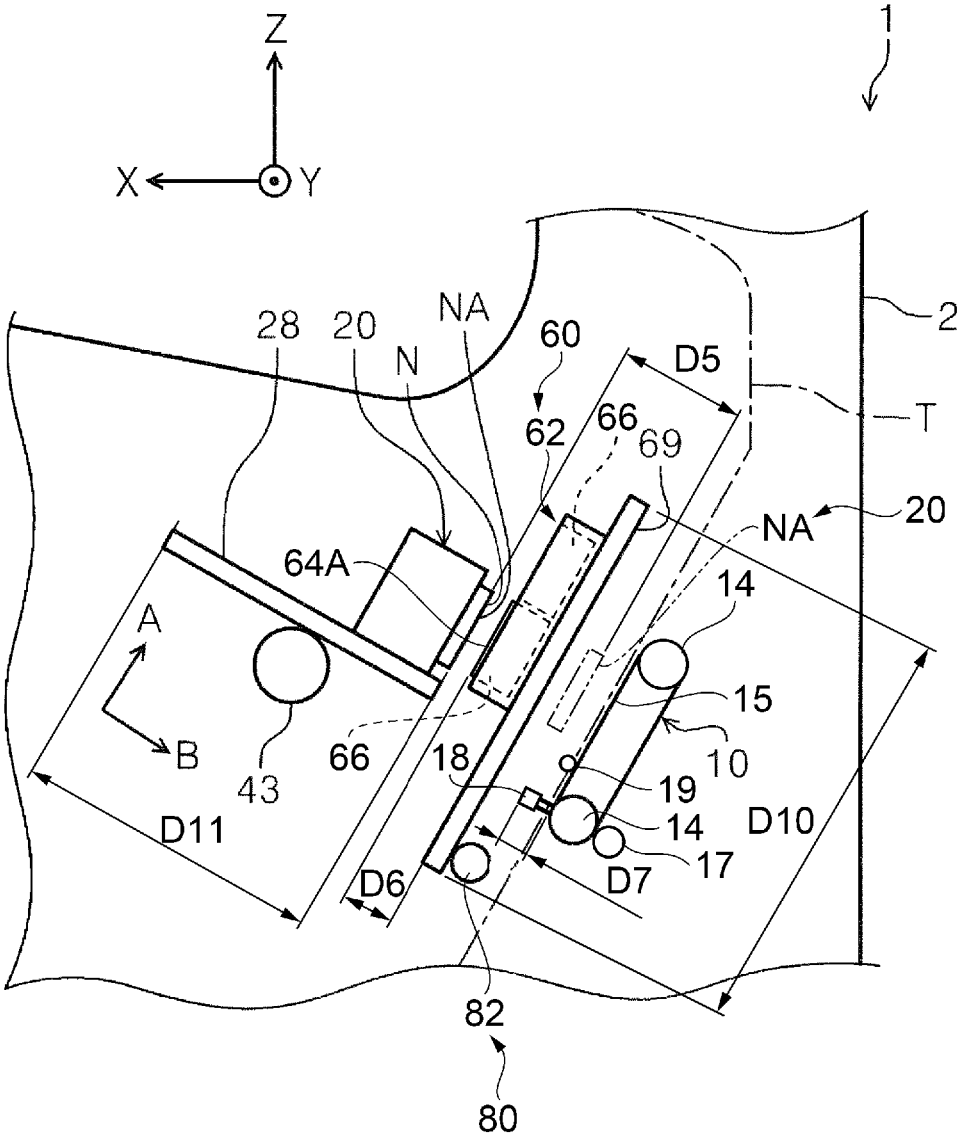
FIG. 12 is a schematic diagram illustrating a state in which the line head according to Embodiment 1 is located at a head standby position before storing.
Figure 13:
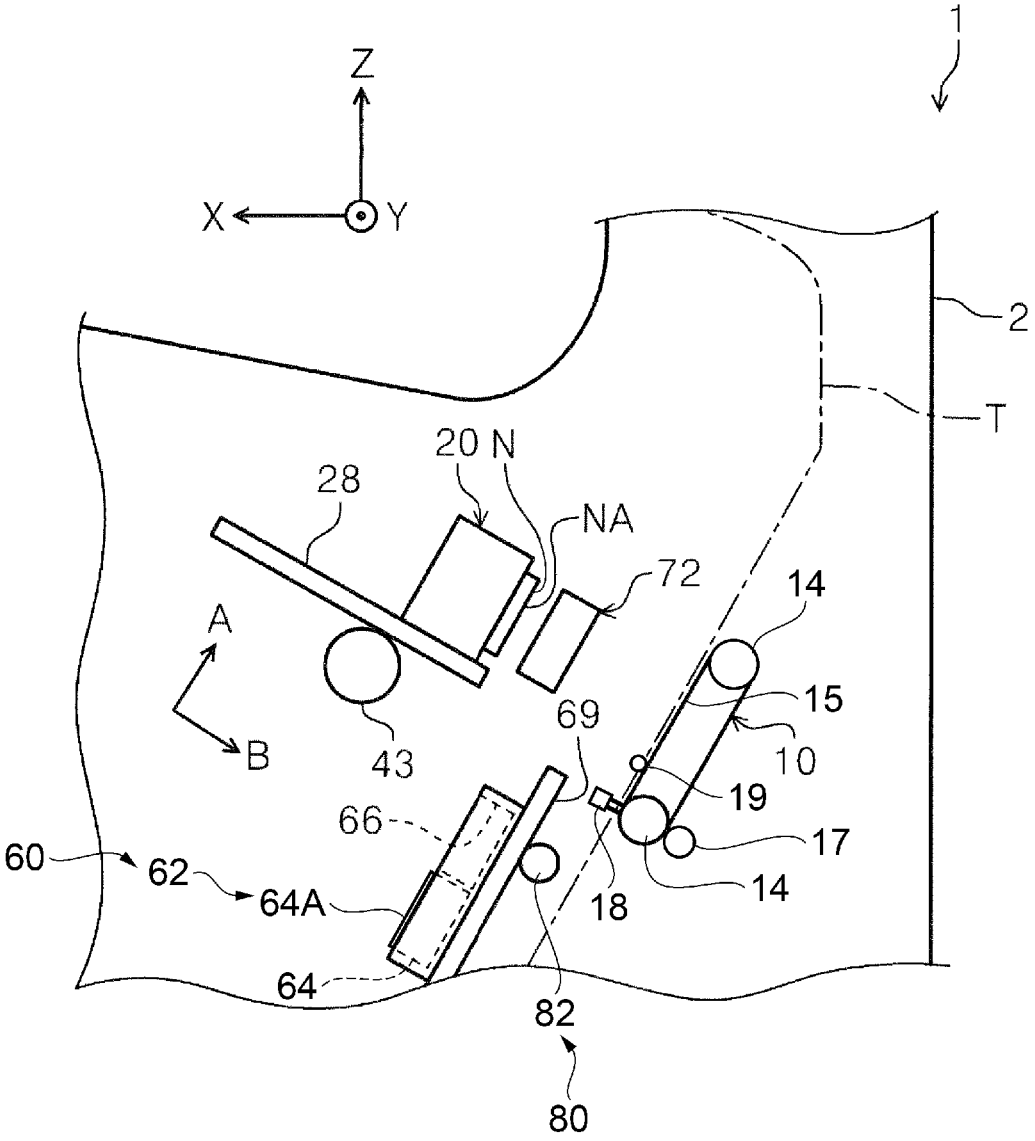
FIG. 13 is a schematic diagram illustrating a state in which the line head according to Embodiment 1 is located at a head standby position before wiping.

As illustrated in FIG. 12 and FIG. 13, the head standby position of the line head 20 means a position at which the line head 20 is farther from the transport unit 10 than the first position, the second position, and the third position in the B direction. This is the position at which the line head 20 stands by until completion of the movement when the first maintenance unit 62 or the second maintenance unit 72 moves. When the line head 20 is at the head standby position and the first maintenance unit 62 moves in the A direction, the second maintenance unit 72 is at the retreat position. Further, when the second maintenance unit 72 moves in the Y direction, the first maintenance unit 62 is at the standby position. Note that, as illustrated in FIG. 12, a movement amount D5 in the B direction in which the head moving portion 30 moves the line head 20 from the recording position indicated by the ejecting surface NA drawn by the two-dot chain line to the head standby position drawn by the solid line is set to be larger than the sum of a dimension D6 of the first maintenance unit 62 in the B direction and a dimension D7 of the static elimination brush 18 in the B direction.

Figure 14:
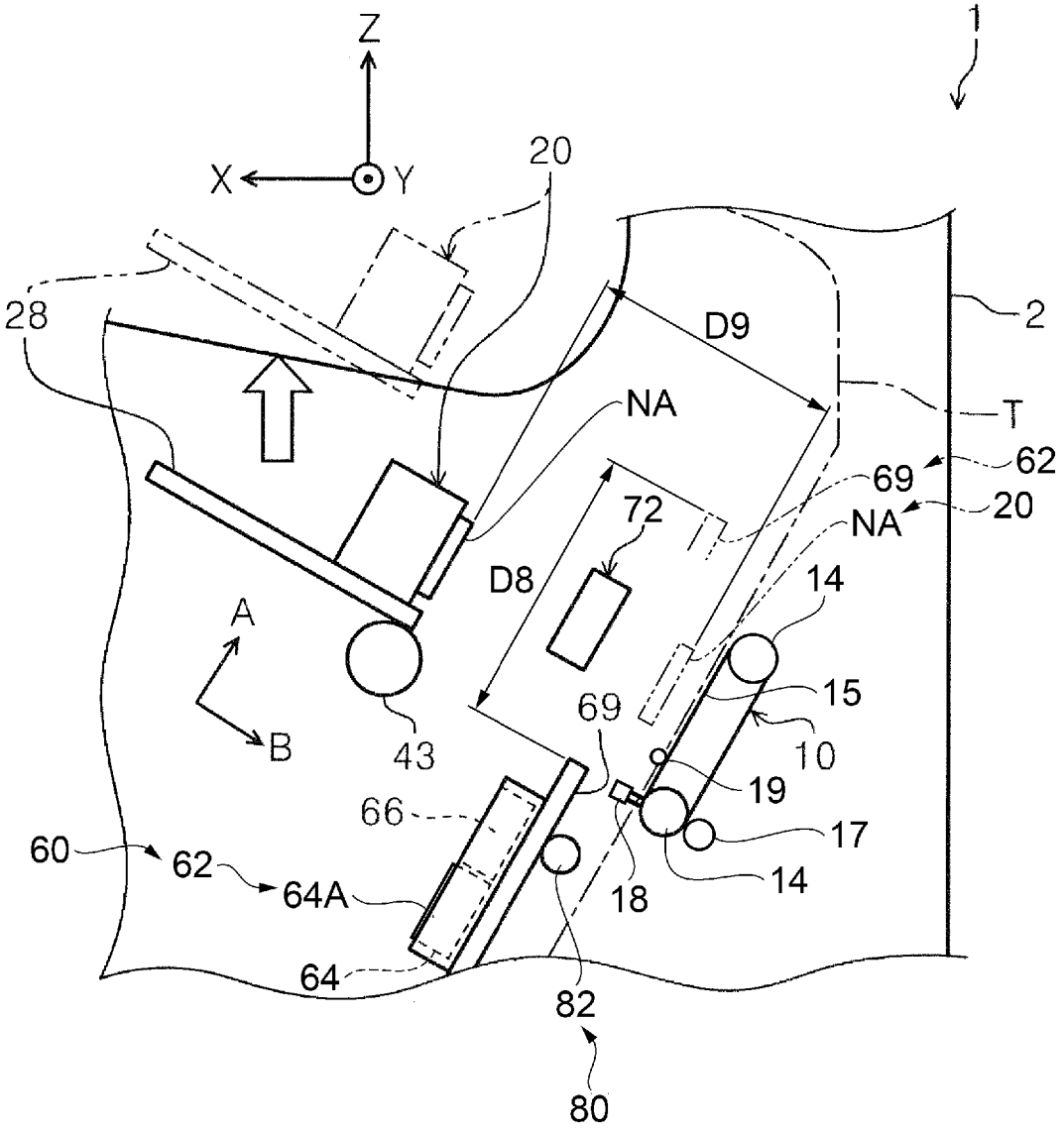
FIG. 14 is a schematic diagram illustrating a state in which the line head according to Embodiment 1 is located at a replacement position.

As illustrated in FIG. 14, the replacement position of the line head 20 means a position in the B direction at which the line head 20 is farther from the transport unit 10 in the −B direction than the head standby position. In other words, the replacement position of the line head 20 is a position farthest from the transport unit 10 in the B direction. When the line head 20 is attached to or detached from the head moving portion 30 at the replacement position, the first maintenance unit 62 is at the standby position, and the second maintenance unit 72 is at the retreat position. At this time, the first maintenance unit 62 at the standby position is located vertically below the ejecting surface NA of the line head 20 at the replacement position. According to this, for example, in a case where the ink drops from the ejecting surface NA when the line head 20 is attached or detached, it is possible to suppress the adhering of dropped ink to the transport route T.

As described above, as an example, the head moving portion 30 is provided so as to be able to move the line head 20 to any one position of the recording position, the first position, the second position, the third position, the head standby position, and the replacement position. Further, the head moving portion 30 is configured to position the line head 20 at the head standby position before positioning the line head 20 at any one of the first position, the second position, and the third position.

Further, as illustrated in FIG. 14, the distance in the B direction between the line heads 20 at the recording position indicated by the ejecting surface NA drawn by the two-dot chain line and at the replacement position drawn by the solid line becomes the maximum movement amount D9 of the line head 20 in the B direction. Further, the distance in the A direction between the first maintenance units 62 at the standby position drawn by the solid line and at the cap position indicated by the end portion of the rack 69 drawn by the two-dot chain line becomes the maximum movement amount D8 of the first maintenance unit 62 in the A direction. In the present embodiment, the maximum movement amount D8 of the first maintenance unit 62 in the A direction is equal to or larger than the maximum movement amount D9 of the line head 20 in the B direction.

Further, the sum of an outer dimension D10 of the first maintenance unit 62 in the A direction illustrated in FIG. 12 and the maximum movement amount D8 of the first maintenance unit 62 in the A direction is larger than the sum of an outer dimension D11 of the line head 20 in the B direction illustrated in FIG. 12 and the maximum movement amount D9 of the line head 20 in the B direction. Further, the maximum movement amount D12 of the second maintenance unit 72 in the Y direction is equal to or larger than the maximum movement amount D8 of the first maintenance unit 62 in the A direction. In addition, the mass of the first maintenance unit 62 is equal to or smaller than the mass of the line head 20. In addition, the mass of the second maintenance unit 72 is equal to or smaller than the mass of the first maintenance unit 62.

As described above, according to the printer 1 according to Embodiment 1, the following effects can be obtained.

Printer 1 includes the transport unit 10 having the support surface that supports the medium P, the line head 20 having the ejecting surface NA that is disposed to face the support surface and recording on the medium P supported by the support surface by ejecting ink from the nozzles N provided on the ejecting surface NA, the head moving portion 30, along the moving direction in which the line head 20 advances and retreats with respect to the transport unit 10, configured to move the line head 20 to the recording position at which recording on the medium P is performed and the retreat position away from the recording position with respect to the transport unit 10, and the first maintenance unit 62 movably provided in the first direction that intersects the moving direction and capable of covering the ejecting surface NA at the position between the line head 20 and the transport unit 10, in which when installed on the horizontal plane, the moving direction intersects the horizontal plane at an angle of 45 degrees or less, the first direction intersects the horizontal plane at an angle of 45 degrees or more and less than 90 degrees, and the movement amount D8 of the first maintenance unit 62 in the first direction is equal to or more than the movement amount D9 of the line head 20 in the moving direction. According to this, since the moving direction of the line head 20 intersects the horizontal plane at an angle of 45 degrees or less, and the first direction, which is the moving direction of the first maintenance unit 62 in which the movement amount is equal to or more than the movement amount of the line head 20, intersects the horizontal plane at an angle of 45 degrees or more and less than 90 degrees, it is easy to reduce the installation area of the printer 1.

The sum of the outer dimension D10 of the first maintenance unit 62 in the first direction and the movement amount D8 of the first maintenance unit 62 in the first direction is larger than the sum of the outer dimension D11 of the line head 20 in the moving direction and the movement amount D9 of the line head 20 in the moving direction. According to this, since the first direction, which is the moving direction of the cap portion in which the dimension occupied in the first direction is larger than the dimension occupied by the head portion in the moving direction, intersects the horizontal plane at an angle of 45 degrees or more, it is easy to further reduce the installation area of the printer 1.

The transport unit 10 transports the medium P supported by the support surface in the transport direction along the first direction, and the first maintenance unit 62 at the cap position covering the ejecting surface NA and the support surface overlap at least partially when viewed from the vertical direction. According to this, since the first maintenance unit 62 is close to the support surface, the dimension in the horizontal direction occupied by the first maintenance unit 62 and the transport unit 10 can be reduced, and the installation area of the printer 1 can be reduced.

The downstream in the transport direction is above the upstream in the transport direction, and the ejecting surface NA is disposed to face the portion on the downstream in the transport direction with respect to the center of the support surface. According to this, since the dimension in the horizontal direction occupied by the first maintenance unit 62 and the transport unit 10 can be reduced, the installation area of the printer 1 can be further reduced.

The transport unit 10 includes the transport belt 15 having the support surface and the two pulleys 14 around which the transport belt 15 is wound, and of the outer dimensions in the horizontal direction of the transport belt 15 wound around the two pulleys 14, the outer dimension D1 in the direction orthogonal to the width direction of the transport belt 15 is smaller than the dimension D2 of the support surface in the transport direction. According to this, since the dimension in the horizontal direction occupied by the transport unit 10 can be reduced, the installation area of the printer 1 can be reduced.

The mass of the first maintenance unit 62 is equal to or less than the mass of the line head 20. According to this, since the mass of the first maintenance unit 62 of which the movement amount is equal to or larger than the movement amount of the line head 20 is equal to or smaller than the mass of the line head 20, the cap moving portion 80 for moving the first maintenance unit 62 is less likely to be large. Further, since the movement amount of the line head 20 of which the mass is equal to or larger than the mass of the first maintenance unit 62 is equal to or smaller than the movement amount of the first maintenance unit 62, the head moving portion 30 is less likely to be large.

The printer 1 further includes the second maintenance unit 72 that is movably provided in the second direction that intersects both the moving direction and the first direction, and is capable of cleaning the ejecting surface NA at the position between the line head 20 and the transport unit 10. The movement amount D12 of the second maintenance unit 72 in the second direction is equal to or larger than the movement amount D8 of the first maintenance unit 62 in the first direction, and the mass of the second maintenance unit 72 is equal to or smaller than the mass of the first maintenance unit 62. According to this, since the mass of the second maintenance unit 72 of which the movement amount is equal to or larger than the movement amount of the first maintenance unit 62 is equal to or smaller than the mass of the first maintenance unit 62, the blade moving portion for moving the second maintenance unit 72 is less likely to be large.

The first direction is orthogonal to the moving direction. According to this, it is possible to reduce the movement amount of the line head 20 from the recording position to the retreat position.

The printer 1 further includes the pick roller 6 that sends out the medium P accommodated in the medium cassette 4 from the medium cassette 4 in the −X direction in the horizontal direction, and the pair of discharge rollers 11B that is disposed above the pick roller 6 and discharges the medium P in the +X direction, which is opposite to the −X direction, toward the discharge portion 3 on which the medium P on which the ink has been ejected are stacked. According to this, it is possible to concentrate the transport route T on one side in the horizontal direction with respect to the center of the housing 2, and it is easy to dispose the line head 20 and the maintenance unit 60 in the housing 2. Therefore, it is easy to reduce the installation area of the printer 1.

The printer 1 further includes the transport route T in which the medium P sent out by the pick roller 6 is transported toward the discharge portion 3 via the transport unit 10, the manual feed tray 9 provided on the −X direction side with respect to the transport route T, and the transport path T2 that joins the transport route T from the −X direction side and can transport the medium P set in the manual feed tray 9 to the transport route T. According to this, it is easy to concentrate the transport route to the discharge portion 3 on the −X direction side of the housing 2, including the transport of the medium P from the manual feed tray 9. Therefore, it is easy to downsize the printer 1.

The printer 1 according to Embodiment 1 of the present disclosure basically have the above-described configurations, but it is needless to say that modifications and omissions of partial configurations and the like can also be made without departing from the spirit and scope of the present disclosure. Further, the above-described embodiments and the other embodiments described below can be implemented in combination with each other within a technically consistent range. Hereinafter, other embodiments will be described.

The first angle θ1 may be the same as the second angle θ2, or may be smaller than the second angle θ2.

The printer 1 may not include the second maintenance unit 72. In addition, the printer 1 may not include the lid unit 90.

The printer 1 may be configured to attach and detach the line head 20 in the Y direction.

In the printer 1, the flushing portion 66 of the first maintenance unit 62 may be disposed on the −A direction side with respect to the cap 64 in the A direction.

The head moving portion 30 may not position the line head 20 at the head standby position before positioning the line head 20 at any one of the first position, the second position, and the third position.

In the printer 1, in the process of moving the first maintenance unit 62 in the A direction, the direction in which the cap surface 64A faces may change. In this case, the cap moving portion 80 may support the first maintenance unit 62 and move the first maintenance unit 62 in the A direction with the cap surface 64A facing in the inclined direction between the X direction and the +Z direction.

In the printer 1, the first direction may not be orthogonal to the moving direction. For example, when the moving direction is the B direction and the first angle θ1, which is an angle formed by the B direction and the X direction, is 30 degrees, the angle formed by the first direction and the X direction may be 70 degrees. In addition, at this time, the transport direction may be the A direction or may not be the A direction. When the transport direction is not the A direction, the transport direction may be along the first direction, and the angle formed by the transport direction and the X direction may be 70 degrees.

In the printer 1, the transport direction may not be orthogonal to the +B direction in which the ejecting surface NA faces. For example, the transport direction of the medium P in the area in which the line head 20 and the transport unit 10 face each other may be the X direction.

What is claimed is:

1. A recording apparatus comprising:

a support portion having a support surface configured to support a medium;

a head portion having an ejecting surface that is disposed to face the support surface, and configured to record on the medium supported by the support surface by ejecting liquid from a nozzle provided on the ejecting surface;

a head moving portion, along a moving direction in which the head portion advances and retreats with respect to the support portion, configured to move the head portion to a recording position at which recording on the medium is performed and a retreat position away from the support portion with respect to the recording position; and a cap portion configured to move in a first direction that intersects the moving direction, and configured to cover the ejecting surface at a position between the head portion and the support portion, wherein when installed on a horizontal plane, the moving direction intersects the horizontal plane at an angle of 45 degrees or less, and the first direction intersects the horizontal plane at an angle of 45 degrees or more and less than 90 degrees, and a movement amount of the cap portion in the first direction is equal to or larger than a movement amount of the head portion in the moving direction.

2. The recording apparatus according to claim 1, wherein a sum of an outer dimension of the cap portion in the first direction and the movement amount of the cap portion in the first direction is larger than a sum of an outer dimension of the head portion in the moving direction and the movement amount of the head portion in the moving direction.

3. The recording apparatus according to claim 1, wherein the support portion transports the medium supported by the support surface in a transport direction along the first direction, and the cap portion at a cap position covering the ejecting surface and the support surface overlap at least partially when viewed from a vertical direction.

4. The recording apparatus according to claim 3, wherein a downstream in the transport direction is above an upstream in the transport direction, and the ejecting surface is disposed to face a portion of the support surface downstream of a center of the support surface in the transport direction.

5. The recording apparatus according to claim 3, wherein the support portion includes a transport belt having the support surface and two pulleys around which the transport belt is wound, and of outer dimensions in a horizontal direction of the transport belt wound around the two pulleys, an outer dimension in a direction orthogonal to a width direction of the transport belt is smaller than a dimension of the support surface in the transport direction.

6. The recording apparatus according to claim 5, wherein a mass of the cap portion is equal to or smaller than a mass of the head portion.

7. The recording apparatus according to claim 6, further comprising a cleaning portion provided to move in a second direction that intersects both the moving direction and the first direction, and configured to clean the ejecting surface at a position between the head portion and the support portion, wherein a movement amount of the cleaning portion in the second direction is equal to or larger than the movement amount of the cap portion in the first direction, and a mass of the cleaning portion is equal to or smaller than the mass of the cap portion.

8. The recording apparatus according to claim 7, wherein the retreat position includes a position of the head portion when the cap portion covers the ejecting surface and a position of the head portion when the cleaning portion cleans the ejecting surface.

9. The recording apparatus according to claim 8, wherein the cleaning portion completes movement when the head portion stands by at the retreat position.

10. The recording apparatus according to claim 8, wherein the retreat position includes a first position at which the cap portion is configured to cover the ejecting surface and a third position at which the cleaning portion is configured to clean the ejecting surface, and the first position is, in the moving direction, closer to the support portion than the third position.

11. The recording apparatus according to claim 7, wherein the retreat position includes a position of the head portion when the cap portion covers the ejecting surface.

12. The recording apparatus according to claim 11, wherein the cap portion completes movement when the head portion stands by at the retreat position.

13. The recording apparatus according to claim 12, wherein the cleaning portion completes movement when the head portion stands by at the retreat position.

14. The recording apparatus according to claim 1, wherein the first direction is orthogonal to the moving direction.

15. The recording apparatus according to claim 1, further comprising:

a pick roller configured to send out the medium accommodated in a medium accommodating portion from the medium accommodating portion in a −X direction in a horizontal direction; and a discharge roller disposed above the pick roller, and configured to discharge the medium in a +X direction that is opposite to the −X direction toward a discharge portion on which the medium on which the liquid was ejected is stacked.

16. The recording apparatus according to claim 15, further comprising:

a transport route at which the medium sent out by the pick roller is transported toward the discharge portion via the support portion;

a manual feed tray provided on a side of the −X direction with respect to the transport route; and a transport path joining the transport route from a side of the −X direction and configured to transport the medium set in the manual feed tray to the transport route.

17. The recording apparatus according to claim 1, wherein the retreat position includes a position of the head portion when the cap portion covers the ejecting surface.

18. The recording apparatus according to claim 17, wherein the cap portion completes movement when the head portion stands by at the retreat position.

19. The recording apparatus according to claim 1, wherein a mass of the cap portion is equal to or smaller than a mass of the head portion.

20. The recording apparatus according to claim 19, further comprising a cleaning portion provided to move in a second direction that intersects both the moving direction and the first direction, and configured to clean the ejecting surface at a position between the head portion and the support portion, wherein a movement amount of the cleaning portion in the second direction is equal to or larger than the movement amount of the cap portion in the first direction, and a mass of the cleaning portion is equal to or smaller than the mass of the cap portion.

* * * * *